US005933994A

United States Patent [19]

Misaresh

[11] Patent Number: 5,933,994

[45] Date of Patent: Aug. 10, 1999

[54] RETAIL CHECKOUT DIVIDER ADAPTED TO RECEIVE STRIPS WITH INDICIA DISPLAYED THEREON

[75] Inventor: Theo Misaresh, Torrance, Calif.

[73] Assignee: Russell & Miller, Inc., Santa Fe Springs, Calif.

[21] Appl. No.: 08/879,172

[22] Filed: Jun. 19, 1997

[51] Int. Cl.[6] ..... G09F 3/18; G09F 3/20

[52] U.S. Cl. ..... 40/649; 40/661

[58] Field of Search ..... 40/649, 661, 611, 40/720, 734, 564, 570, 572, 575, 577, 502, 506, 660

[56] References Cited

U.S. PATENT DOCUMENTS

| | | | |
|---|---|---|---|
| 432,968 | 7/1890 | Bayley | 40/502 |
| 574,789 | 1/1897 | Dodge . | |
| 719,597 | 2/1903 | Lee | 40/660 |
| 1,553,702 | 9/1925 | Maclaren | 40/660 X |
| 1,756,547 | 4/1930 | Hansen . | |
| 1,785,582 | 12/1930 | Hansen | 40/660 X |
| 2,071,912 | 2/1937 | Auer | 250/67 |
| 2,156,553 | 5/1939 | Vendope | 40/131 |
| 2,162,025 | 6/1939 | McClaughry | 40/152 |
| 2,172,528 | 9/1939 | Auer | 250/67 |
| 2,553,160 | 5/1951 | Arps | 40/502 |
| 2,599,921 | 6/1952 | Johnson | 40/140 |
| 2,730,824 | 1/1956 | Cohen | 40/1.5 |
| 2,741,046 | 4/1956 | Kroslak | 40/125 |
| 2,768,457 | 10/1956 | Biek | 40/19 |
| 2,918,741 | 12/1959 | Welter et al. | 40/10 |
| 3,022,592 | 2/1962 | Faulkner | 40/140 |
| 3,343,289 | 9/1967 | Chamberlin | 40/16 |
| 3,345,766 | 10/1967 | Timlin | 40/502 |
| 3,367,049 | 2/1968 | Noreen | 40/649 X |
| 3,430,373 | 3/1969 | Shaffer | 40/502 X |
| 3,452,463 | 7/1969 | Chaput | 40/17 |
| 3,561,146 | 2/1971 | Dembar | 40/661 |
| 3,771,246 | 11/1973 | Ebner | 40/720 |
| 3,790,772 | 2/1974 | Newman et al. | 40/577 X |
| 3,820,262 | 6/1974 | Dewsnap | 40/10 |
| 3,826,026 | 7/1974 | Bevan | 40/10 |
| 3,838,529 | 10/1974 | Aybar | 40/64 |
| 3,918,187 | 11/1975 | Vogele | 40/156 |
| 3,924,344 | 12/1975 | Davis | 40/129 |
| 3,963,344 | 6/1976 | Pralle | 312/245 |
| 4,019,269 | 4/1977 | Vix | 40/660 |
| 4,055,012 | 10/1977 | Cote | 40/129 |
| 4,059,914 | 11/1977 | Dobson | 40/125 |
| 4,117,533 | 9/1978 | Hagelthorn | 40/575 X |
| 4,144,661 | 3/1979 | Gosanko et al. | 40/10 |
| 4,164,084 | 8/1979 | Crockett | 40/660 |
| 4,211,805 | 7/1980 | Chamberlin | 428/40 |
| 4,227,325 | 10/1980 | Whitford | 40/660 X |
| 4,329,801 | 5/1982 | Clausen | 40/660 X |
| 4,344,244 | 8/1982 | Tyke | 40/611 |
| 4,387,809 | 6/1983 | Botzler | 206/526 |
| 4,408,406 | 10/1983 | Barton | 40/660 |
| 4,534,126 | 8/1985 | Gilman | 40/19 |
| 4,625,441 | 12/1986 | Fast | 40/10 |

(List continued on next page.)

FOREIGN PATENT DOCUMENTS

| | | |
|---|---|---|
| 824882 | 11/1951 | Germany . |
| 7804274-4 | 11/1979 | Sweden . |
| WO 93/19448 | 9/1993 | WIPO . |

OTHER PUBLICATIONS

Modern plastics p. 181, Jun. 1946.

*Primary Examiner*—Michael F. Trettel
*Assistant Examiner*—Robert G. Santos
*Attorney, Agent, or Firm*—Seidal, Coonda, Lavorgna & Monaco, PC

[57] ABSTRACT

A retail checkout divider is provided as a transparent fixture having a hollow interior. The interior of the fixture has holders forming slots adapted to receive strips with indicia displayed thereon. The strips are held within the slots by either flexible cylinders or end caps. The present invention provides for a checkout divider where display strips can be easily and conveniently changed.

8 Claims, 3 Drawing Sheets

U.S. PATENT DOCUMENTS

| | | | |
|---|---|---|---|
| 4,672,757 | 6/1987 | Field | 40/10 |
| 4,704,770 | 11/1987 | Minami et al. | 40/661 X |
| 4,707,939 | 11/1987 | Bonner et al. | 40/591 |
| 4,726,132 | 2/1988 | Ernest | 40/10 |
| 4,745,695 | 5/1988 | Hetzer | 40/10 |
| 4,763,428 | 8/1988 | Fischer | 40/152 |
| 4,866,868 | 9/1989 | Kass | 40/661 |
| 4,884,353 | 12/1989 | Taylor | 40/611 |
| 4,909,178 | 3/1990 | Le Broog | 40/660 X |
| 4,973,951 | 11/1990 | Shigeta et al. | 40/572 X |
| 5,018,291 | 5/1991 | Pasquale et al. | 40/642 |
| 5,020,256 | 6/1991 | French | 40/661 |
| 5,056,248 | 10/1991 | Blanchard | 40/322 |
| 5,080,516 | 1/1992 | Ward | 40/661 X |
| 5,105,567 | 4/1992 | Real | 40/158 |
| 5,197,215 | 3/1993 | Torsleff | 40/642 |
| 5,226,252 | 7/1993 | Haluska | 40/661 X |
| 5,230,172 | 7/1993 | Hsu | 40/734 X |
| 5,241,768 | 9/1993 | Thompson | 40/661 |
| 5,272,826 | 12/1993 | Gingras | 40/621 |
| 5,309,659 | 5/1994 | Eastman | 40/600 |
| 5,331,758 | 7/1994 | Romick | 40/661 |
| 5,419,134 | 5/1995 | Gibson | 40/606 |
| 5,423,142 | 6/1995 | Douglas et al. | 40/605 |
| 5,430,974 | 7/1995 | Hering | 49/47 |
| 5,450,926 | 9/1995 | Fraser | 186/59 |
| 5,700,051 | 12/1997 | Newhouse | 40/649 |

FIG. 1
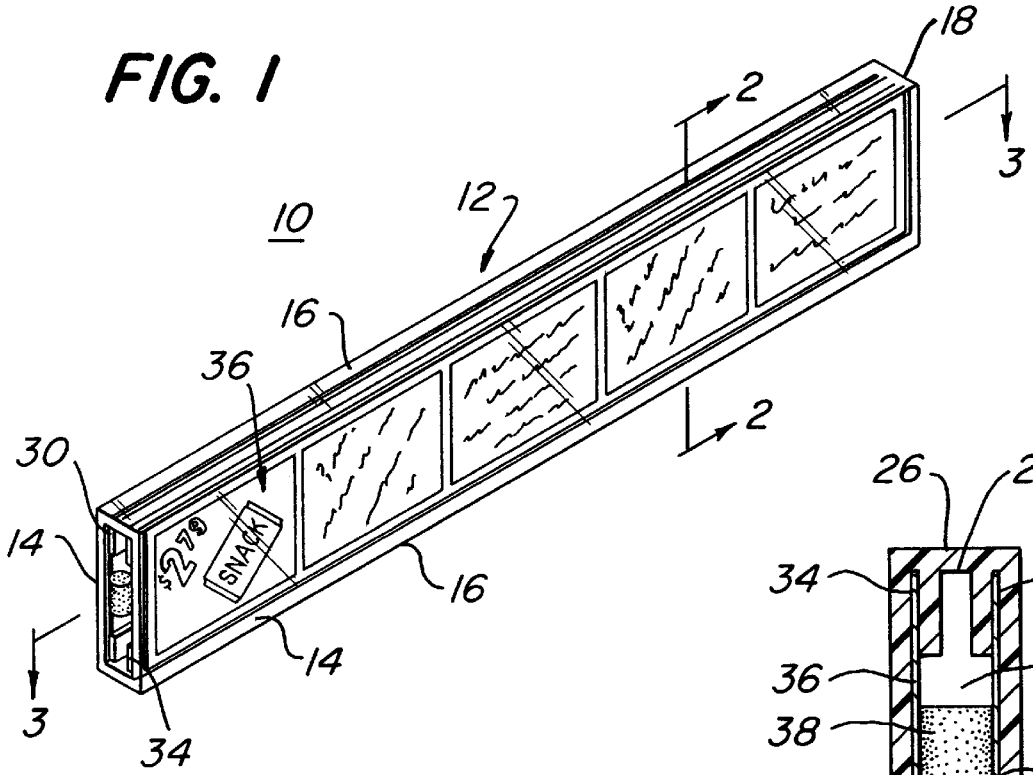
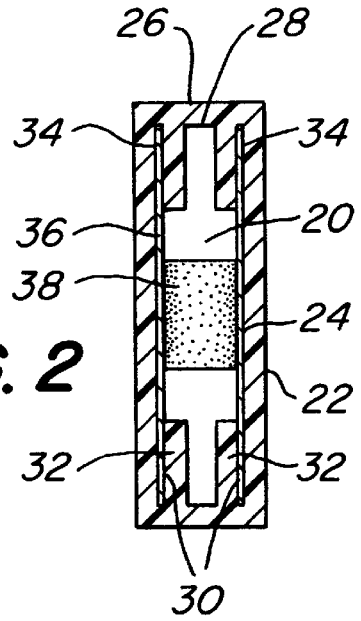
FIG. 2
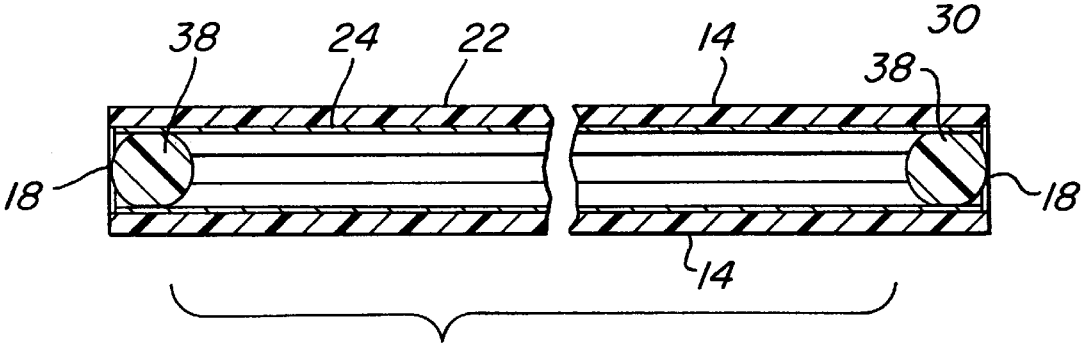
FIG. 3

FIG. 4
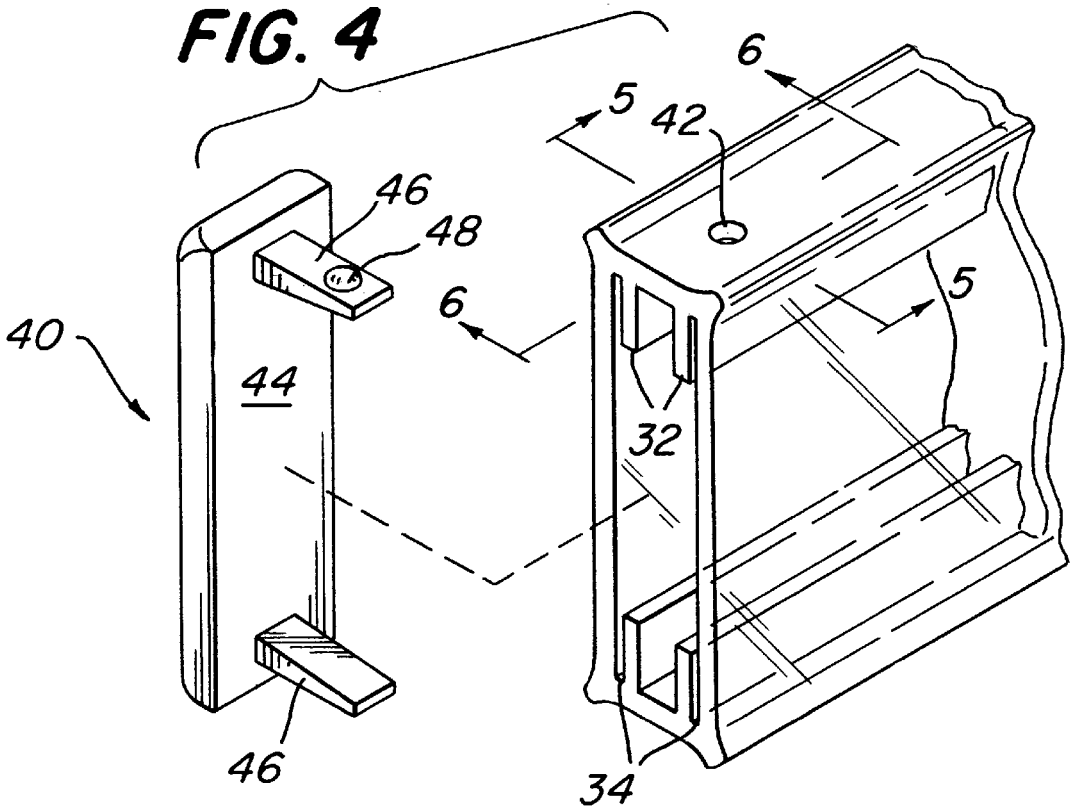
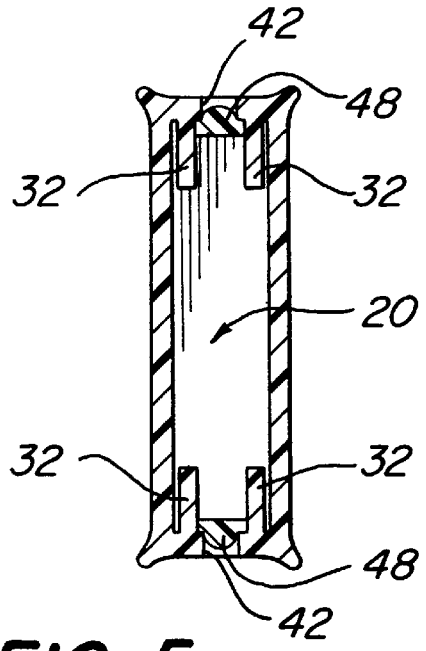
FIG. 5
FIG. 6
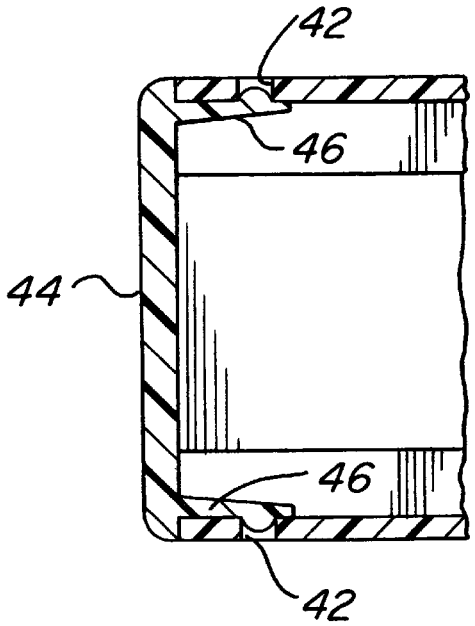

RETAIL CHECKOUT DIVIDER ADAPTED TO RECEIVE STRIPS WITH INDICIA DISPLAYED THEREON

FIELD OF THE INVENTION

This invention relates to the field of display advertising and more particularly to the display of advertising or promotions at the check-out counter in a grocery/drug/hardware or any other retail establishment that has an area where customers wait in line and there is a need for the products they purchase to be separated. The present invention provides an article for use as a retail checkout divider exhibiting changeable indicia. The present invention provides a convenient and time-saving means for changing the advertising indicia exhibited to a customer as they check out their purchases.

BACKGROUND OF THE INVENTION

Currently, it is common in the art of retail purchasing to have a divider available to consumers at the retail checkout aisle, so that one consumer's purchases remain separate from another consumer's purchases. These known dividers are available to customers as they place their purchases on a conveyor belt, for example, to be rung up by a cashier. While these dividers sometimes display indicia showing the name of a supplier or retail store, these dividers rarely, if ever, display store specials, promotional materials, advertising, and the like.

Most dividers currently in use in the retail shopping environment are permanently imprinted with the indicia to be displayed. Therefore, it is impossible to quickly and easily change the indicia to reflect changing merchandise and sales. Moreover, even where it is possible to change the indicia in or on a divider, it is often cumbersome or time-consuming to do so.

There is, accordingly, the need for a retail checkout divider having changeable indicia.

There is also the need for a retail checkout divider where the indicia can be easily and quickly changed.

There is further the need for a retail checkout divider where the indicia can be easily and quickly changed that is inexpensive.

SUMMARY OF THE INVENTION

The present invention is directed to a retail checkout divider that satisfies the need for a checkout divider where the indicia being displayed can be easily changed. The present invention provides an innovative and effective solution to the problems associated with existing checkout dividers. A retail checkout divider having features of the present invention comprises a transparent fixture having open ends. The fixture has side walls defining a hollow interior. Holders are provided which project into the interior of the fixture and are adapted to receive strips having display indicia thereon. End caps or flexible cylinders are provided which are adapted to close the open ends of the fixture, and press and/or flatten the indicia against the inner surface of the fixture.

The present invention is a vast improvement over existing checkout dividers, due to the control a merchant or other user has over the display of indicia.

Further, the present invention allows the user to easily and inexpensively change the indicia being displayed, without the need for completely replacing the checkout divider.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 shows a perspective view of a retail checkout divider made in accordance with the present invention.

FIG. 2 shows a cross sectional view of the divider taken along line 2—2 in FIG. 1.

FIG. 3 shows a cross sectional view of the divider taken along line 3—3 in FIG. 1.

FIG. 4 shows a partial perspective exploded view of a retail checkout divider made in accordance with the present invention.

FIG. 5 shows a cross sectional view of the divider taken along line 5–5 in FIG. 4.

FIG. 6 shows a cross sectional view of the divider taken along line 6—6 in FIG. 4.

DETAILED DESCRIPTION OF THE PREFERRED EMBODIMENT

Figure 7:
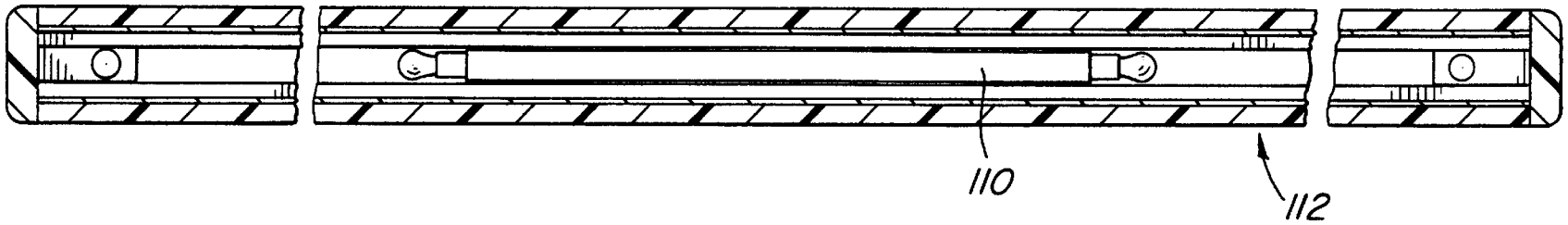
FIG. 7 shows a cross sectional view of another embodiment of the present invention.

Referring to the drawings, wherein like numerals refer to like elements, the present invention generally comprises a retail checkout divider having side walls defining a hollow interior, with slots formed therethrough for receiving display strips. As shown in FIGS. 1 through 6, in one embodiment of the invention, the divider 10 comprises a fixture 12 having substantially transparent display walls 14, side walls 16 connecting the display walls 14, and open ends 18. The display walls 14 and the side walls 16 define a hollow interior 20. Each display wall 14 has an outer surface 22 and an inner surface 24, and each side wall 16 has an outer surface 26 and an inner surface 28.

The divider 10 has holders 30 which project into the interior 20 of the fixture 12. In the embodiment of the present invention shown in FIGS. 1 through 6, the holders 30 are formed as flanges 32 which project from the inner surface 28 of each side wall 16 into the interior 20 of the fixture 12. The flanges 32 are located adjacent the inner surface 24 of each display wall 14. The flanges 32 are in opposing orientation, forming slots 34 adjacent the inner surface 24 of each display wall 14. Each slot 34 is adapted to receive display strips 36 which have indicia displayed thereon.

Closures are provided for closing off the open ends 18 of the fixture 12. It is contemplated that these closures can take various forms. As shown in FIGS. 2 & 3, the closures may be formed as flexible cylinders 38, formed from plastic, foam, or other suitable materials. These cylinders 38 frictionally engage the interior 20 of the fixture 12 and aid in holding the display strips 36 against the inner surface 24 of each display wall 14.

As shown in FIGS. 4, 5 & 6, it is also contemplated that the closures may take the form of end caps 40. When end caps 40 are used, the fixture 12 is initially formed having mating apertures 42 located adjacent each open end 18. Each end cap 40 is formed having an end wall 44, with flanges 46 extending from a face of the end wall 44. The flanges 46 are adapted to extend into the interior 20 of the fixture 12. The flanges 46 are formed having projections 48 which are adapted to be in mating engagement with the apertures 42. It is further contemplated that the attachment of the end caps 40 to the fixture 12 can be accomplished using any arrangement where the end caps and the fixture have cooperating mating elements.

Figure 8:
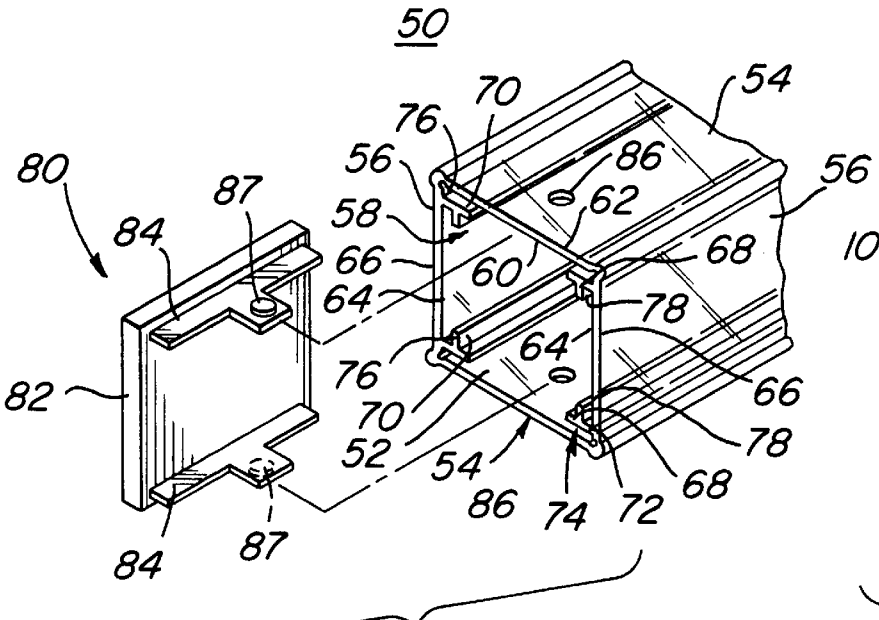
FIG. 8 shows a partial perspective exploded view of another embodiment of a retail checkout divider made in accordance with the present invention.

In another embodiment of the present invention, shown in FIG. 8, the divider is formed so that indicia can be displayed through each wall of the divider. The divider is formed as a fixture 50 having open ends 52, display walls 54, and side walls 56 connecting the display walls 54, with the display walls 54 and the side walls 56 forming a hollow interior 58. Each display wall 54 has an inner surface 60 and an outer surface 62. Each side wall 56 also has an inner surface 64 and an outer surface 66.

As shown in FIG. 8, flanges 68 are provided which define slots 70 for receiving display strips 36 with indicia printed thereon. As shown in FIG. 8, first flanges 72 project from the inner surface 64 of each side wall 56 into the interior 58 of the fixture 50, and form slots 74 adjacent the inner surface 60 of each display wall 54. These slots 74 are adapted to receive display strips 36 with indicia printed thereon.

Second flanges 76 extend transversely from the first flanges 72 within the interior 58 of the fixture 50. The second flanges 76 form slots 78 adjacent the inner surface 64 of each side wall 56 for receiving strips 36 having indicia displayed thereon.

The open ends 52 of this embodiment of the invention can be closed off using end caps 80. These end caps 80 may be formed having an end wall 82 with flanges 84 extending from the end wall 82. The fixture 50 is formed having mating apertures 86 located adjacent the open ends 52. The flanges 84 have projections 87 which are adapted to be in mating engagement with the apertures 86. The end caps 80 may engage the fixture 50 using any cooperating mating elements as described above.

Figure 9:
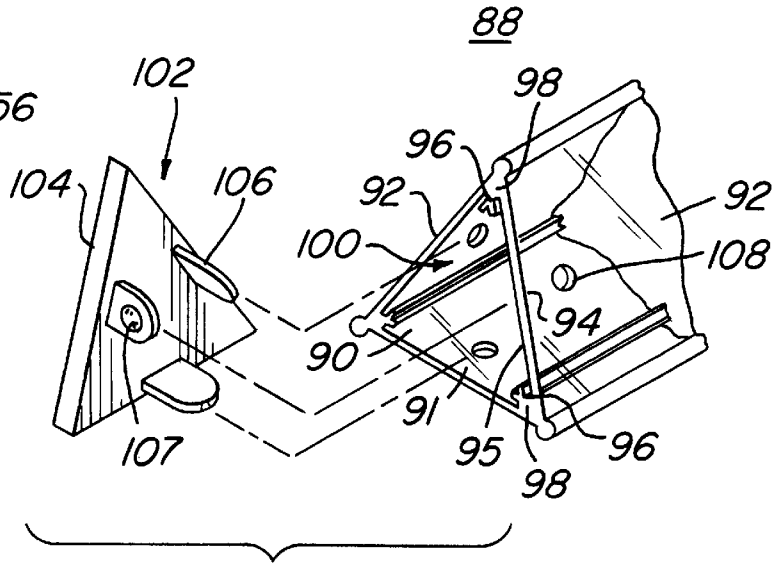
FIG. 9 shows a partial perspective exploded view of another embodiment of a retail checkout divider made in accordance with the present invention.

In yet another embodiment of the present invention, as shown in FIG. 9, a divider is provided as a fixture 88 having display walls 92 defining a hollow interior 90, open ends 91, and having a triangular cross-section. Each display wall 92 has an outer surface 94 and an inner surface 95.

Substantially V-shaped flanges 96 are provided which project into the interior 90. The V-shaped flanges 96, project into the interior 90 from the corners 98 where the display walls 92 meet. The flanges 96 form slots 100 adjacent the inner surface 94 of each display wall 92.

The open ends of this embodiment of the invention can be closed off using end caps 102. These end caps 102 may be formed having a end wall 104 with flanges 106 extending from the end wall 104. The fixture 88 is formed having apertures 108 located adjacent the open ends 89. The flanges 106 have projections 107 thereon adapted to be in mating engagement with the apertures 108. The end caps 102 may engage the fixture 88 using any cooperating mating elements as described above.

In a further embodiment of the present invention, as shown in FIG. 7, a light source 110 is provided within the fixture 112. Using this embodiment, display strips formed, for example, of translucent material, may be backlit, to produce a more striking appearance. It is contemplated that the light source 110 can be powered by either batteries or a solar cell.

In use, strips 36 having indicia displayed thereon are placed in the slots 34 of the fixture 12. The fixture 12 is then used by customers in a retail setting, for example in the retail checkout line where conveyor belts are often used, to separate their respective purchases. Customers waiting to be checked out can view the display indicia displayed on the strips 36 as they wait. When the merchant or retailer wants to change display strips 36, the end caps 40 or flexible cylinders 38 are easily removed, and the new strips are inserted into the slots 34. The end caps 40 or flexible cylinders 38 are replaced, so that the strips 36 will not slide out of the fixture 12 during use. Further, the flexible cylinders 38 press the strips 36 against the inner surface 24 of each display wall 14, thereby keeping the strips 36 straight and presenting a uniform appearance.

The present invention may be embodied in other specific forms without departing from the spirit or essential attributes thereof and, accordingly, reference should be made to the appended claims, rather than to the foregoing specification, as indicating the scope of the invention.

What I claim is:

1. A retail checkout divider, comprising:

(a) a transparent fixture having side walls defining a hollow interior, holders projecting from the side walls into the interior, the holders being adapted to receive strips with indicia displayed thereon, the fixture having open ends; and (b) detachable closures adapted to close the open ends of the fixture and to hold the strips within the fixture, the closures comprising flexible cylinders sized to frictionally engage the hollow interior of the fixture and adapted to frictionally hold the strips in place.

2. The retail checkout divider according to claim 1, wherein the side walls further comprise an inner surface, the holders define a plurality of slots within the interior of the fixture, the slots located adjacent the inner surface of the side walls, the slots being adapted to receive strips with indicia displayed thereon.

3. The retail checkout divider according to claim 2, wherein the holders comprise flanges, the flanges extending from the inner surface of the side walls into the interior, the flanges located adjacent the inner surface of an adjacent side wall, the flanges forming slots for receiving strips with indicia displayed thereon.

4. A retail checkout divider, comprising:

(a) a transparent fixture comprising:

(i) display walls, the display walls having an outer surface and an inner surface, (ii) side walls connecting the display walls, the side walls having an outer surface and an inner surface, the display walls and the side walls defining a hollow interior, the fixture having open ends; and (b) flanges formed within the fixture, the flanges projecting from the inner surface of the side walls into the interior and located adjacent the inner surface of the display walls, the flanges forming slots adjacent the inner surface of the display walls for receiving strips having indicia displayed thereon; and (c) detachable closures adapted to close the open ends of the fixture and to hold the strips within the fixture, the closures comprising flexible cylinders sized to frictionally engage the hollow interior of the fixture and adapted to frictionally hold the strips in place.

5. A retail checkout divider, comprising:

(a) a transparent fixture comprising:

(i) display walls, the display walls having an outer surface and an inner surface, (ii) side walls connecting the display walls, the side walls having an outer surface and an inner surface, the display walls and the side walls defining a hollow interior, the fixture having open ends; and (b) flanges formed within the fixture, the flanges projecting from the inner surface of the side walls into the interior and located adjacent the inner surface of the display walls, the flanges forming slots adjacent the inner surface of the display walls for receiving strips having indicia displayed thereon, the flanges comprising:

(i) first flanges, the first flanges projecting from the inner surface of the side walls into the interior and located adjacent the inner surface of the display walls, the first flanges forming slots adjacent the inner surface of the display walls for receiving strips having indicia displayed thereon, and (ii) second flanges extending transversely from the first flange, the second flanges forming slots adjacent the inner surface of the side walls for receiving strips having indicia displayed thereon; and (c) detachable closures adapted to close the open ends of the fixture and to hold the strips within the fixture.

6. The retail checkout divider according to claim 5, wherein the closures further comprise flexible cylinders sized to frictionally engage the hollow interior of the fixture and adapted to frictionally hold the strips in place.

7. A retail checkout divider, comprising:

(a) three display walls defining a hollow interior, each display wall having an outer surface and an inner surface;

(b) substantially V-shaped flanges projecting into the interior from the inner surfaces of the display walls, the V-shaped flanges located adjacent the corners where display walls meet, the V-shaped flanges forming slots adjacent the inner surface of each display wall for receiving strips having indicia displayed thereon; and (c) detachable closures, each closure adapted to close the open ends of the retail checkout divider, each closure adapted to hold the strips within the interior of the retail checkout divider, the closures comprising flexible cylinders sized to frictionally engage the hollow interior of the retail checkout divider and adapted to frictionally hold the strips in place.

8. A retail checkout divider, comprising:

(a) three display walls defining a hollow interior, each display wall having an outer surface and an inner surface;

(b) substantially V-shaped flanges projecting into the interior from the inner surfaces of the display walls, the V-shaped flanges located adjacent the corners where display walls meet, the V-shaped flanges forming slots adjacent the inner surface of each display wall for receiving strips having indicia displayed thereon;

(c) the retail checkout divider having apertures located adjacent the open ends; and (d) detachable closures, each closure adapted to close the open ends of the retail checkout divider, each closure adapted to hold the strips within the interior of the retail checkout divider, the closures comprising end caps, the end caps and the retail checkout divider having cooperating mating elements which releasably attach the end caps to the retail checkout divider, the end caps comprising:

(i) an end wall, (ii) flanges extending from a face of the end wall, the flanges having protrusions thereon, the protrusions adapted to releasably engage the apertures.

* * * * *